US005383395A

United States Patent [19]

Buschulte

[11] Patent Number: 5,383,395

[45] Date of Patent: Jan. 24, 1995

[54] DEVICE FOR ADJUSTING THE SUPPLY OF INK IN THE VARIOUS INK ZONES OF A PRINTING PRESS

[75] Inventor: Rainer Buschulte, Bad Schönborn, Germany

[73] Assignee: Heidelberger Druckmaschinen Aktiengesellschaft, Heidelberg, Germany

[21] Appl. No.: 168,532

[22] Filed: Dec. 15, 1993

[30] Foreign Application Priority Data

Dec. 17, 1992 [DE] Germany ..... 4242744

[51] Int. Cl.[6] ..... B41F 31/04

[52] U.S. Cl. ..... 101/365; 101/485

[58] Field of Search ..... 101/365, 350, 349, 148, 101/363, 485, 157, 169; 118/261

[56] References Cited

U.S. PATENT DOCUMENTS 3,730,090 5/1973 Lamberg et al. ..... 101/365

*Primary Examiner*—J. Reed Fisher

*Attorney, Agent, or Firm*—Nils H. Ljungman & Associates

[57] ABSTRACT

An adjusting device for providing a zonewise adjustment of the ink gap with respect to the ink-fountain roller in a printing press is manually adjustable via a respective adjusting screw, and has an additional device for performing a coarse adjustment in a relatively short period of time. A plurality of such devices can be disposed side by side along the ink-fountain roller for providing numerous ink zones along the ink-fountain roller to thereby substantially reduce adjustment time for setting up an ink profile.

18 Claims, 3 Drawing Sheets

DEVICE FOR ADJUSTING THE SUPPLY OF INK IN THE VARIOUS INK ZONES OF A PRINTING PRESS

BACKGROUND OF THE INVENTION

1. Field of the Invention

The invention generally relates to an adjusting device provided at an offset or letterpress machine for zonally adjusting the ink gap with respect to the ink-fountain roller. Such a device can generally be used to thereby regulate the quantity of ink picked up by the ink-fountain roller. A printing press will typically have a plurality of such adjusting devices disposed side by side, adjacent one another, in an axial direction of the ink-fountain roller, and each of the adjusting devices can be manually adjustable via adjusting screws.

2. Background Information

One such type of adjusting device, as described above, is disclosed in Federal Republic of Germany Patent No. DE 27 11 553 A1. The adjusting device disclosed therein uses adjusting screws for adjusting the individual devices. The adjusting screws are advantageously designed so as to feature a fine thread with a fine pitch to thereby allow for a very fine adjustment of the ink gap. However, with such a device, it has become apparent that, when, e.g., effecting an adjustment from a zero position to a maximal-inking position, the pressman has to turn the adjusting screw a fairly large number of turns because of the fine pitch of the threads. For this reason, the pressman would have to spend a relatively long time, e.g., turning each of the adjusting screws of an ink fountain, which could number more than thirty, in order to adjust the individual adjusting means for every zone of the ink profile of one inking unit. If the pressman is in charge of a machine having a plurality of inking units, adjusting the machine to a new print product can take a relatively long time, merely due to the ink-zone adjustments.

OBJECT OF THE INVENTION

On the basis of the above described device, it is the object of the present invention to expedite the manual adjustment of the individual adjusting means without losing the great sensitivity that can be provided by an adjusting device fine threads.

SUMMARY OF THE INVENTION

According to the present invention this object is achieved by a device in which the thread of the adjusting screw engages the thread pitches of geared wheels which are mounted in a clamping body. The geared wheels can preferably be mounted in such a manner that the rotary motion of the geared wheels is decelerated frictionally, or, in other words, is inhibited during a fine screw adjustment, while for a coarse adjustment, the frictional engagement can be overcome to allow for a more rapid setting of the adjustment device. For providing a coarse adjustment of the ink gap, a swivelling lever can preferably be mounted in conjunction with the adjusting screw, and, when being swivelled, can cause the frictional engagement to be overcome to allow for a rapid axial displacement of the adjusting screw to thereby rapidly move the adjusting device connected to the adjusting screw.

This solution permits the pressman to carry out first, a coarse pre-adjustment of the adjusting device, followed by a fine adjustment via the adjusting screw.

Thus, with the device according to the present invention, the pressman may cover a large adjusting range in a very short time and would then preferably only need to turn the adjusting screw only a few more times so that an exact adjustment could be manually performed within a rather short time.

In an advantageous embodiment of the invention the adjusting screw can extend into, and preferably through the clamping body. In addition, the clamping body can preferably have an elongated slot and a projection, with a spring element acting on the projection, so that the geared wheels are decelerated and pressed onto the thread of the adjusting screw in a play-free manner. The elongated slot can preferably be disposed about the clamping body to reduce the wall thickness of the clamping body, thereby giving the clamping body a deformability towards the geared wheels. The spring element can then be disposed about the clamping body at a position spaced apart from the elongated slot to clamp the walls of the clamping body into a tight engagement with the geared wheels, thereby frictionally engaging the wheels between wall portions of the clamping body. This ensures a very exact adjustment of the adjusting elements.

In a further advantageous embodiment, the swivelling lever can encompass the adjusting screw and can transmit the swivel motion without play onto the adjusting screw via compression springs. Due to the fact that the adjusting lever can be precisely guided with relation to the adjusting screw, the position of the adjusting lever may be monitored, e.g., by apparatus of a dial, so that the position of the adjusting lever during a pre-adjustment can provide an essentially approximate determination of the current setting.

One aspect of the invention resides broadly in a printing press comprising a frame; a plate cylinder being rotatably mounted on the frame; a plurality of ink applicator rollers for being engaged with the plate cylinder and for applying ink to the plate cylinder; a plurality of inking rollers for applying ink to the plurality of ink applicator rollers; the plate cylinder having a printing width for accommodating ink, and the plurality of inking rollers having an inkable width corresponding to the printing width of the plate cylinder and apparatus for supplying ink to the plurality of inking rollers. The apparatus for supplying ink comprises apparatus for holding a supply of ink; a receiving roller for receiving ink from the ink supply apparatus and for distributing the ink to the plurality of inking rollers, the receiving roller having an inkable width corresponding to the inkable width of the plurality of inking rollers; metering apparatus for determining an amount of ink received by the receiving roller; apparatus for finely adjusting the metering apparatus to finely adjust the metering apparatus and precisely determine the amount of ink received by the receiving roller; and apparatus for overriding the fine adjustment apparatus to coarsely adjust the metering apparatus, the coarse adjusting being substantially coarser than the fine adjusting.

Another aspect of the invention resides broadly in an ink-dosing apparatus for supplying ink to an ink distribution roller in a printing press. The apparatus comprises: apparatus for holding a supply of ink; a receiving roller for receiving ink from the ink supply apparatus and for distributing the ink to the ink distribution roller, the receiving roller having an inkable width; metering apparatus for determining an amount of ink received by the receiving roller; apparatus for finely adjusting the metering apparatus to finely adjust the metering apparatus and precisely determine the amount of ink received by the receiving roller; and apparatus for overriding the fine adjustment apparatus to coarsely adjust the metering apparatus, the coarse adjusting being substantially coarser than the fine adjusting.

One additional aspect of the invention resides broadly in a method for supplying ink to an ink distribution roller in a printing press, the printing press comprising apparatus for holding a supply of ink; a receiving roller for receiving ink from the ink supply apparatus and for distributing the ink to the ink distribution roller, the receiving roller having an inkable width with a plurality of ink zones defined along the inkable width; and a plurality of metering apparatus corresponding to the ink zones for determining an amount of ink received by the receiving roller in each of the ink zones. The method comprises the steps of: providing ink into the ink supply apparatus; and adjusting each of the metering apparatus to determine an amount of ink received by the receiving roller in each of the plurality of ink zones, the adjusting comprising, for each of the plurality of ink zones, at least one of: finely adjusting the metering apparatus to precisely determine the amount of ink received by the receiving roller; and overriding the fine adjustment apparatus to coarsely adjust the metering apparatus, the coarse adjusting being substantially coarser than the fine adjusting.

BRIEF DESCRIPTION OF THE DRAWINGS

A specimen embodiment of the invention is schematically illustrated in the drawings, in which.

DESCRIPTION OF THE PREFERRED EMBODIMENTS

Figure 1:
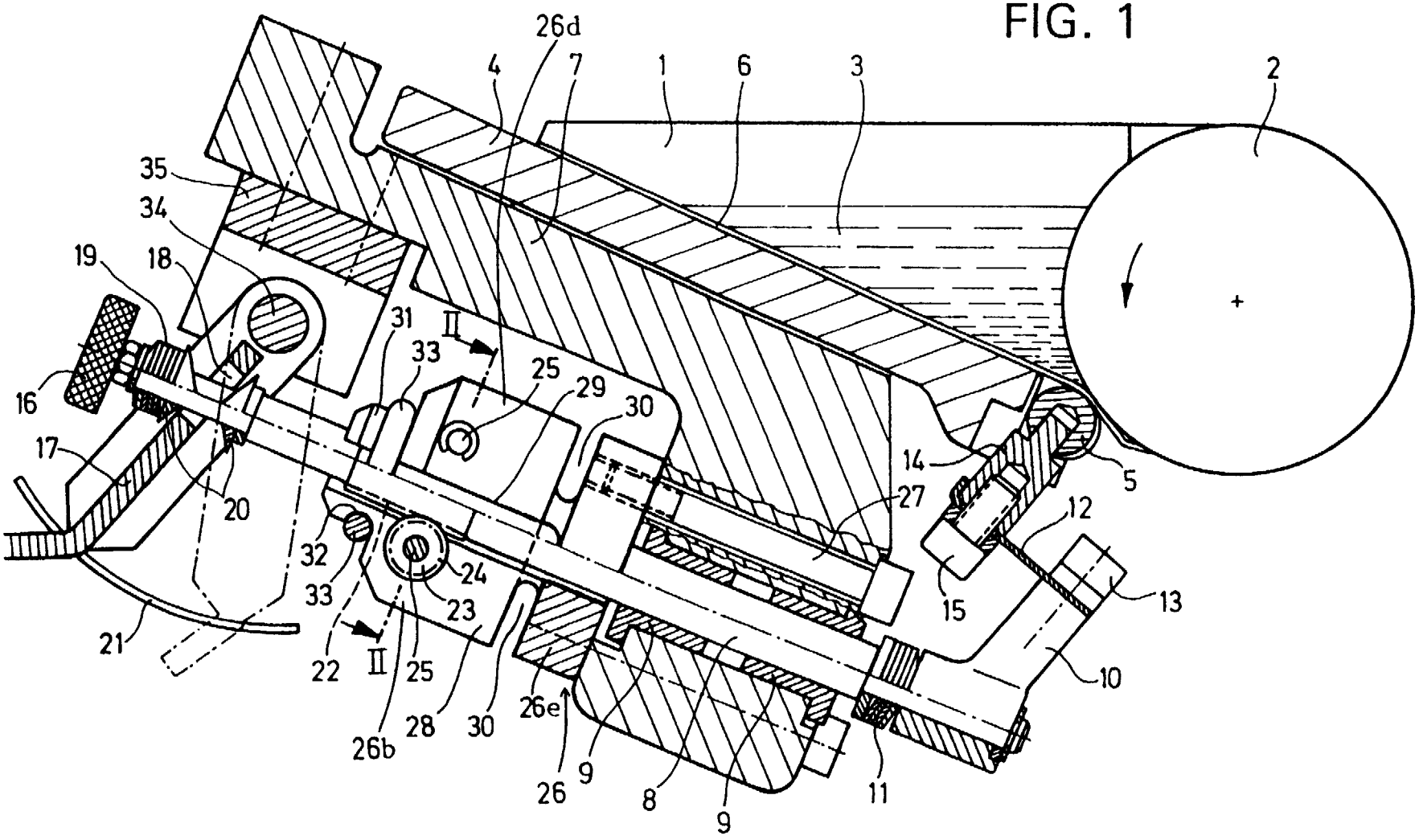
FIG. 1 is a cross-section of an adjusting device provided at an ink fountain.
Figure 1A:
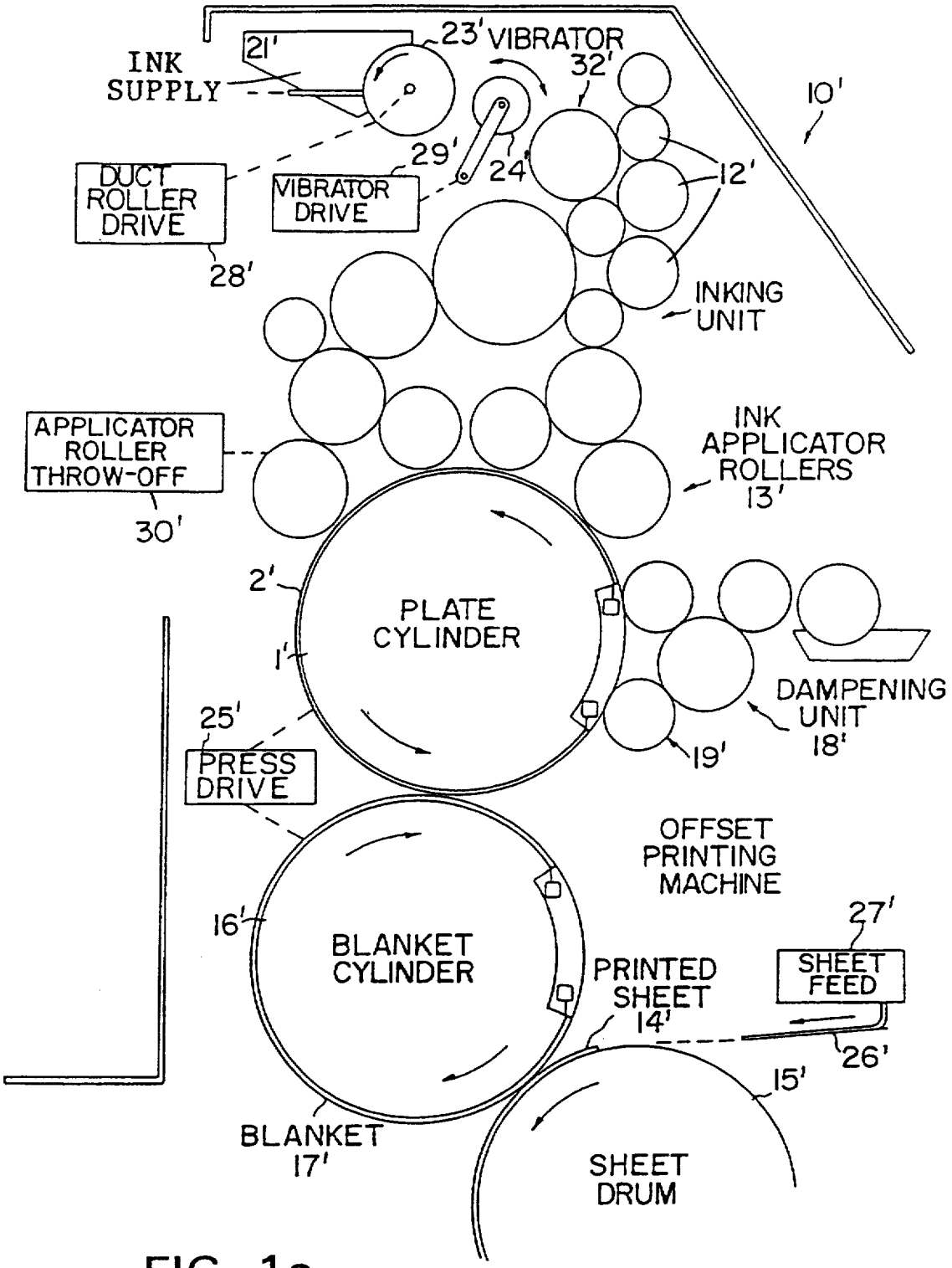
FIG. 1*a* schematically illustrates a printing press in which the present invention may be employed.

In general, as shown in FIG. 1*a*, a printing press can have a print stand 10' which can provide a supporting framework for the internal components thereof. Such components of a printing press, depending on the type of printing press, can include a plate cylinder 1' for having mounted thereon a printing plate 2', and an inking unit for transferring ink to the plate cylinder 1'. The inking unit can essentially be considered to include an ink fountain 21' a duct roller 23' for picking up ink from the ink fountain 21', a vibrator roller 24' which oscillates to successively pick up ink from duct roller 23' and deposit the same on a roller 32', and a plurality of ink transfer rollers 12' for transferring the ink from the roller 32' to the ink applicator rollers 13'.

By means of appropriate metering devices (discussed further below), an ink profile can be established along the ink transfer rollers 12' and the ink application rollers 13', which ink profile can thereby also be established on the printing plate 2' about the plate cylinder 1'. The printing press can also include a dampening (or wetting) unit 18' having dampening applicator rollers 19' for transferring a dampening agent to the printing plate 2'.

Once the printing plate 2' has been inked, the ink impression of the printing plate can preferably be applied to a rubber blanket 17' on a blanket cylinder 16'. The rubber blanket 17' can receive the ink impression from the printing plate 2', and can transfer the image to a sheet of printing stock 26' to produce a printed sheet 14'. This sheet of printing stock 26' can be supplied by means of a sheet drum 15' in conjunction with a sheet feed device 27' for supplying the sheets 26' to the press.

Typically, the printing stand 10' can also include auxiliary mechanisms such as, for example, a duct roller drive 28', a vibrator roller drive 29', an applicator roller throw-off 30' for lifting the ink applicator rollers 13' off of the printing plate 2', and a press drive 25' for driving appropriate rollers, i.e. at least plate cylinder 1' and blanket cylinder 16'.

As shown in more detail in FIG. 1, the ink fountain 1 generally has an ink-fountain roller 2 and holds the ink 3 required for a print job. Along the longitudinal dimension of the roller 2, there would generally be a plurality of inking zones aligned side by side over the inking width of the roller 2. Each of these zones would have a zone width, and can preferably be independently adjusted to vary the amount of ink deposited on the roller 2. The bottom of the ink fountain 1 can preferably be formed by pressure rails 4 which may be of zonewide design in the specimen embodiment shown and which may also preferably accommodate the also zonewide adjusting means 5 for metering the ink film to be conveyed into the inking unit.

The pressure rails 4 and the adjusting means 5 may be covered with an elastic foil 6. Under the force of springs the pressure rails 4 may press the adjusting means 5, via the foil 6, onto the ink-fountain roller 2. For this purpose, the pressure rails 4 can preferably be supported on an ink-fountain traverse 7 which can be mounted in the machine side frame.

An adjusting screw 8 can preferably be accommodated in a bushing 9 mounted in the ink-fountain traverse 7. At one end of the adjusting screw 8 there can preferably be a pivot-mounted arm 10 which, via a spring 11, can preferably be held without play in relationship to the adjusting screw 8. By means of a fastener, such as screw 13, a spring-type joint 12 can be attached to the end of the arm 10. A lever 14 can preferably be fastened to each adjusting means 5, and the spring-type joint 12 can be attached to the lever 14 by means of a fastening device, such as screw 15. When the adjusting screw 8 executes a movement along an axial direction of the adjusting screw 8, this movement can essentially be transmitted onto the adjusting means 5, via the arm 10, the spring-type joint 12 and the lever 14. In this manner, the adjusting means 5 can be adjusted in order for the metering gap, or gap between the adjusting means 5 and the roller 2, to provide the amount of ink desired in a particular ink zone. In the specimen embodiment shown in FIG. 1 the adjusting means 5 is shown in what could be termed a "zero position".

On the side of the adjusting screw 8, opposite the arm 10, there can preferably be a knurled nut 16 by means of which the adjusting screw 8 may be turned. Alternatively, other types of devices which would increase the graspability of the screw 8 could also be used. Next to the knurled nut 16 there can preferably be a swivelling lever 17 which can feature a recess 18 that at least partially surrounds the adjusting screw 8. Here, too, there can preferably be compression springs 19, by means of which the swivelling lever 17 may be connected to the adjusting screw 8 in each position without play. For this purpose inclined roof-shaped, or domed discs 20 can be provided. As set forth above, a dial 21 may be assigned to the swivelling lever 17. This dial 21 could preferably have referencing marks, or numbers thereon indicating the respective position of the lever 17 and thus of the adjusting means 5.

Figure 2:
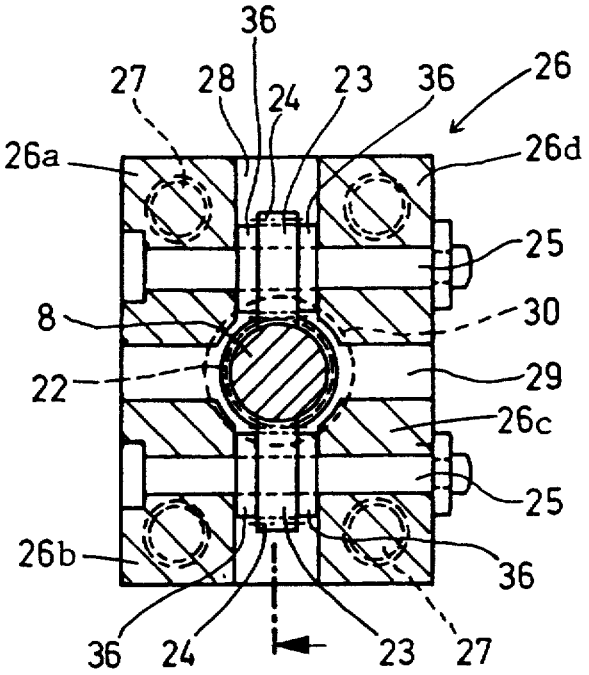
FIG. 2 is a cross-section of the clamping body.

In the middle region of the adjusting screw 8, there can preferably be a threaded portion 22 which, in the embodiment shown, can mesh with a respective wheel 23 from above and below. The wheel can preferably have a toothing 24 at its outer circumference, with the toothing matching the pitch of the thread 22. The threaded portion 22 can thus act as a worm, and at the wheels 23 can act as a worm gear. Via journals 25, both toothed wheels 23 can be mounted in a clamping body 26, shown in different views in both FIGS. 1 and 2.

The adjusting screw 8 can preferably extend through the clamping body 26 which, in turn, can be fastened to the ink-fountain traverse 7 via screws 27. The clamping body 26 can preferably be slotted crosswise to have slots 28 and 29 therein along at least a portion of the length of the clamping body 26. The slot 28 can preferably receive both wheels 23 therein, and the slots 28 and 29 can preferably extend transversely to one another, thereby dividing the clamping block 26 into a number of sections, which, as shown in the drawings can include four sections **26*a*–26*d*. By means of the slots 28 and 29, an elastic behavior can be given to the clamping body 26, or, in other words, the clamping body sections 26*a*–26*d*** can preferably be moved towards and away from one another.

The clamping body 26 can also preferably have a base portion **26*e* for being fastened to the traverse 7, as discussed previously. Adjacent this base portion 26*e*, a further recess 30 can preferably extend about the periphery of the clamping body to reduce the thickness of the sections 26*a*–26*d* at one end thereof adjacent the base 26*e*. Because of this reduction in thickness, the elastic behavior of the sections 26*a*–26*d* can be enhanced, as the reduced thickness allows for greater mobility. At the other end of the sections 26*a*–26*d*, or what could be termed the front region of the clamping body 26, there can preferably be a projection 31 which defines a groove 32 therein about an outer circumference of the projection 31. This groove 32 can preferably be configured to receive an elastic device 33 therein to provide a clamping force to pull the sections 26*a*–26*d* towards one another. In essence, this projection 31 can be formed by a projecting portion of each of the block sections 26*a*–26*d***

Within the slot 28, the geared wheels 23 can preferably be mounted about the journals 25 in conjunction with friction rings 36 disposed on either side of the wheels 23, between the wheels 23 and the adjoining sections **26*a*–26*d* of the clamping body 26**.

By means of the elastic device 33, which can be an elastomeric O-ring or another type of biasing member, the slotted regions of the clamping body 26 can be pressed together to reduce the slots between the sections **26*a*–26*d* and clamp the geared wheels 23 between the friction rings 36. This clamping action can thus urge, without play, the geared wheels 23 with their toothing 24 onto the threads of the threaded portion 22 of the adjusting screw 8. Due to these forces and by compressing the slot 28 by means of the elastic device 33 both gears 23 can preferably be frictionally engaged so that their rotary motion is decelerated, or hindered. Thus, under situations in which fine adjustments of the adjustment means 5 would be needed, the adjusting screw 8 can be turned via the knurled nut 16, whereby the threads of threaded portion 22 could then turn in the toothing 24 of the gears 23, (inhibited from rotating) and the adjusting screw 8 could be axially displaced. In such situations wherein fine adjustments might be needed, it is preferable that the gears do not rotate, or rotate only minimally, due to the frictional engagement of the geared wheels 23, thereby enabling the screw 8 to be displaced in relationship to the gears 23 upon a turning of the screw 8**.

On the other hand, if a coarse, or more rapid adjustment of the adjusting means 5 was desired, the swivelling lever 17 could be manipulated to overcome the frictional engagement of the gears 23. By pivoting the swivelling lever 17 from one position to another, a force can be provided to the gears 23 by means of the engaged teeth of portion 22. When the applied force is greater than the forces causing the frictional engagement of the gears 23, the frictional engagement of the gears 23 can be overcome and the gears 23 can thus rotate according to the swivel motion of the swivelling lever 17. As soon as the swivel motion of the swivelling lever 17 has come to an end, as set forth hereinabove, the adjusting screw 8 may be finely adjusted via the knurled nut 16. Here, too, the swivelling lever 17 can preferably precisely indicate the respective position on the dial 21. Both movements i.e. turning the knurled nut 16 and swivelling the swivelling lever 17 can cause an axial displacement of the adjusting screw 8, and while lever 17 and screw 8 are interconnected, both movements can be carried out independently of each other.

The swivelling lever 17 can be pivot-mounted in a bearing 35 via a journal 34. The bearing 35 can, in turn, be fastened to the ink-fountain traverse 7 of the ink fountain 1.

One feature of the invention resides broadly in the adjusting device provided at an ink-fountain of an offset or letterpress machine comprising an adjusting means for the zonewise adjustment of the ink gap with respect to the ink-fountain roller, the adjusting means being disposed side by side in axial direction of the ink-fountain roller and being each manually adjustable via a respective adjusting screw, characterized in that the thread 22 of the adjusting screw 8 engages the thread pitches of geared wheels 23 engaging the thread pitch, that the geared wheels 23 are mounted in a clamping body 26, that the rotary motion of the geared wheels is decelerated due to their frictional engagement, and that to the adjusting screw 8 there is assigned a swivelling lever 17 which is provided at the ink fountain 1, 7 and which, when being swivelled, axially displaces the adjusting screw 8 after having overcome the frictional engagement of the gears 23, and actuates the adjusting means 5 connected to the adjusting screw 8.

Another feature of the invention resides broadly in the adjusting device, characterized in that the adjusting screw 8 extends into the clamping body 26, and that the clamping body 26 is slotted 28, 29, 30 and features a projection 31 on which a spring element 33 acts so that the geared wheels 23 are decelerated and pressed onto the thread 22 of the adjusting screw 8 without play.

Yet another feature of the invention resides broadly in the adjusting device, characterized in that the swivelling lever 17 encompasses the adjusting screw 8 and, via compression springs, transmits the swivel motion onto the adjusting screw 8 without play.

All, or substantially all, of the components and methods of the various embodiments may be used with at least one embodiment or all of the embodiments, if any, described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. P 42 42 744, filed on Dec. 17, 1992, having inventor Rainer Buschulte, and DE-OS P 42 42 744 and DE-PS P 42 42 744, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

LIST OF REFERENCE NUMERALS

1 ink fountain
2 ink-fountain roller
3 ink
4 pressure
5 adjusting means
6 foil
7 ink-fountain traverse
8 adjusting screw
9 bushing
10 arm
11 spring
12 spring-type joint
13 screw
14 lever
15 screw
16 knurled nut
17 swivelling lever
18 recess
19 compression spring
20 disc
21 dial
22 thread
23 gear
24 toothing
25 journal
26 clamping body
27 screw
28 slot
29 slot
30 recess
31 projection
32 groove
33 spring element
34 journal
35 bearing
36 friction means

What is claimed is:

1. A printing press comprising:

a frame;

a plate cylinder rotatably mounted on said frame, the plate cylinder having a printing width;

a plurality of ink applicator rollers for being engaged with said plate cylinder and for applying ink to said plate cylinder;

a plurality of inking rollers for applying ink to said plurality of ink applicator rollers;

said plate cylinder having a printing width for accommodating ink, and said plurality of inking rollers having an inkable width corresponding to the printing width of said plate cylinder;

means for supplying ink to said plurality of inking rollers; and said means for supplying ink comprising;

means for holding a supply of ink;

a receiving roller for receiving ink from said ink supply means and for distributing the ink to said plurality of inking rollers, said receiving roller having an inkable width corresponding to the inkable width of said plurality of inking rollers;

metering means for determining an amount of ink received by said receiving roller, said metering means comprising a first member disposed adjacent said receiving roller and movable with respect to said receiving roller to define an ink gap between said receiving roller and said first member, said ink gap corresponding to a thickness of ink deposited on said inking roller;

means for finely adjusting said metering means to finely adjust said metering means and precisely determine the amount of ink received by said receiving roller; and means for overriding said fine adjustment means to coarsely adjust said metering means, said coarse adjusting being substantially coarser than said fine adjusting; said means for finely adjusting comprises:

a threaded rod having threads disposed therearound, said threaded rod defining a longitudinal axis, and said threaded rod being movable in an axial direction along said longitudinal axis, said first member being connected to said threaded rod to move along with said threaded rod;

a second member having threads for engaging said threads of said threaded rod;

means for retaining said threads of said second member in a substantially fixed position; and means for rotating said threaded rod to move said threaded rod over said second member in said axial direction to move said first member with respect to said receiving roller; and said means for overriding said fine adjustment means comprises means for releasing said means for retaining to axially displace said threads of said second member in said axial direction;

said second member comprises at least one toothed gear;

said means for retaining comprises clamp means for frictionally engaging said at least one toothed gear and retaining said toothed gear from rotating; and said means for releasing comprises lever means for applying an axial force on said threaded rod to move said threaded rod in said axial direction, said lever means being configured to apply an axial force sufficient to overcome said frictional engagement and rotate said toothed gear to displace said threads of said second member in said axial direction.

2. The printing press according to claim 1, wherein:

said clamp means comprises a clamping body, said clamping body defining a longitudinal axis, and said clamping body having a longitudinal bore disposed along said longitudinal axis;

said threaded rod being disposed through said longitudinal bore;

said clamping body comprises a first slot intersecting with said longitudinal bore, said first slot dividing said clamping body into a first portion and a second portion;

said at least one toothed gear being disposed within said first slot between said first portion and said second portion; and said clamping body comprises biasing means configured for pulling said first portion and said second portion towards one another to frictionally engage and clamp said toothed gear therebetween.

3. The printing press according to claim 2, wherein:

said clamping body comprises one additional slot intersecting said longitudinal bore and disposed substantially transverse to said first slot;

said additional slot dividing said first portion into third and fourth portions and dividing said second portion into fifth and sixth portions;

said biasing means being configured to pull each of said third, fourth, fifth and sixth portions towards one another towards said longitudinal axis of said clamping body;

said third and fifth portions are disposed adjacent one another and comprise a journal pin disposed therebetween and traversing said first slot, said toothed gear being rotatably mounted on said journal pin; and said biasing means being configured to bias said toothed gear into engagement with said threaded rod.

4. The printing press according to claim 3, wherein:

said clamping body has a first end disposed towards said lever means, and an outer surface, the outer surface being disposed a distance from said longitudinal bore;

said first and said additional slot each have a slot length extending from the first end of said clamping body along said longitudinal axis of said clamping body, said first and said additional slot each have a first end at said first end of said clamping body, and a second end within said clamping body;

said clamping body further comprises a peripheral slot disposed about said longitudinal axis adjacent said second end of said first and said additional slot, said peripheral slot extending from said outer surface of said clamping body towards said longitudinal bore along a substantial portion of the distance between said outer surface and said longitudinal bore;

at said first end of said clamping body, each of said third, fourth, fifth and sixth body portions comprise a projection adjacent said longitudinal axis; and said biasing means comprises a ring-shaped resilient member disposed about said projections to bias said third, fourth, fifth and sixth body portions towards said longitudinal axis.

5. The apparatus according to claim 4, wherein:

said lever means has a first end and a second end, said first end of said lever means being pivotably mounted with respect to said clamping body, and said second end of said lever means being pivotable towards and away from said clamping body;

said lever means has a first side and a second side with an orifice therein from said first side to said second side adjacent said first end;

said threaded rod passes through said orifice of said lever means;

said threaded rod comprises conical surface portions adjacent said first and second sides of said lever means;

said threaded rod has a first end adjacent said metering means and a second end opposite to said first end;

said means for rotating comprises a friction surface at said first end of said threaded rod, said friction surface comprising a knurled nut;

said threaded rod further comprises compression springs disposed between said knurled nut and said conical surfaces to compress said conical surfaces into engagement with said lever means for movement of said threaded rod upon movement of said lever means, and movement of said lever means upon rotation of said threaded rod;

said means for supplying ink further comprises a metered gauge disposed adjacent said second end of said lever means, said metered gauge being configured to represent the gap width between said first member of said metering means and said receiving roller;

said second end of said lever means being pivotable adjacent said metered gauge to indicate the position of said first member with respect to said receiving roller;

said first end of said threaded rod comprises means for connecting said first member to said threaded rod;

said connecting means comprises a flexible joint;

said third, fourth, fifth and sixth body portions each comprise an approximately ¼ section of said clamping body;

said means for supplying ink further comprises one additional toothed gear disposed within said first slot, said toothed gears being disposed on opposite sides of said longitudinal bore of said clamping body;

said fourth and sixth body portions comprise a journal pin disposed therebetween traversing said first slot, said additional toothed gear being rotatably mounted on said journal pin between said fourth and sixth body portion;

each of said toothed gears comprise a first side surface and a second side surface;

said clamping body further comprises friction means disposed between said body portions and said first and second side surfaces of said toothed gears;

said receiving roller comprises a plurality of ink zones defined along the inkable width of said receiving roller; and said printing press comprises a plurality of said metering means disposed along the inkable width of said receiving roller, with each metering means defining an ink zone.

6. An ink-dosing apparatus for supplying ink to an ink distribution roller in a printing press, said apparatus comprising:

means for holding a supply of ink;

a receiving roller for receiving ink from said ink supply means and for distributing the ink to said ink distribution roller, said receiving roller having an inkable width;

metering means for determining an amount of ink received by said receiving roller;

means for finely adjusting said metering means to finely adjust said metering means and precisely determine the amount of ink received by said receiving roller;

means for overriding said fine adjustment means to coarsely adjust said metering means, said coarse adjusting being substantially coarser than said fine adjusting;

said means for finely adjusting comprising:

a threaded rod having threads disposed thereabout, said threaded rod defining a longitudinal axis, and said threaded rod being movable in an axial direction along said longitudinal axis to adjust said metering means;

means for interacting with said threaded rod, said means for interacting with said threaded rod comprising:

means for engaging said threads of said threaded rod; and means for resisting movement of said means for engaging to maintain said means for engaging in a substantially fixed position; and means for rotating said threaded rod to move said threaded rod and adjust said metering means;

said means for overriding said fine adjustment means comprises means for overriding said means for resisting movement; and said means for overriding said means for resisting movement comprises means for applying an axial force on said threaded rod to displace said means for engaging and move said threaded rod in said axial direction.

7. The ink-dosing apparatus according to claim 6, wherein:

said metering means comprises a first member disposed adjacent said receiving roller and movable with respect to said receiving roller to define an ink gap between said receiving roller and said first member, said ink gap corresponding to a thickness of ink deposited on said inking roller;

said first member being operatively connected to said threaded rod to move along with said threaded rod;

said means for engaging comprises a second member having threads for engaging said threads of said threaded rod; and said means for resisting movement comprises means for frictionally engaging said second member to maintain said threads of said second member in a substantially fixed position; and said means for overriding said fine adjustment means comprises means for releasing said means for frictionally engaging to axially displace said threads of said second member in said axial direction.

8. The ink-dosing apparatus according to claim 7, wherein:

said second member comprises at least one toothed gear;

said means for frictionally engaging comprises clamp means for frictionally engaging said at least one toothed gear and retaining said toothed gear from rotating; and said means for applying an axial force comprises lever means for applying said axial force on said threaded rod to move said threaded rod in said axial direction, said lever means being configured to apply an axial force sufficient to overcome said frictional engagement and rotate said toothed gear to displace said threads of said second member in said axial direction.

9. The ink-dosing apparatus according to claim 8, wherein:

said clamp means comprises a clamping body, said clamping body defining a longitudinal axis, and said clamping body having a longitudinal bore disposed along said longitudinal axis;

said threaded rod is disposed through said longitudinal bore;

said clamping body comprises a first slot intersecting with said longitudinal bore, said first slot dividing said clamping body into a first portion and a second portion;

said at least one toothed gear is disposed within said first slot between said first portion and said second portion; and said clamping body comprises biasing means configured for pulling said first portion and said second portion towards one another to frictionally engage and clamp said toothed gear therebetween.

10. The printing press according to claim 9, wherein:

said clamping body comprises one additional slot intersecting said longitudinal bore and disposed substantially transverse to said first slot;

said additional slot dividing said first portion into third and fourth portions and dividing said second portion into fifth and sixth portions;

said biasing means being configured to pull each of said third, fourth, fifth and sixth portions towards one another towards said longitudinal axis of said clamping body;

said third and fifth portions are disposed adjacent one another and comprise a journal pin disposed therebetween and traversing said first slot, said toothed gear being rotatably mounted on said journal pin; and said biasing means being configured to bias said toothed gear into engagement with said threaded rod.

11. The printing press according to claim 10, wherein:

said clamping body has a first end disposed towards said lever means, and an outer surface, the outer surface being disposed a distance from said longitudinal bore;

said first and said additional slot each have a slot length extending from the first end of said clamping body along said longitudinal axis of said clamping body, said first and said additional slot each have a first end at said first end of said clamping body, and a second end within said clamping body;

said clamping body further comprises a peripheral slot disposed about said longitudinal axis adjacent said second end of said first and said additional slot, said peripheral slot extending from said outer surface of said clamping body towards said longitudinal bore along a substantial portion of the distance between said outer surface and said longitudinal bore;

at said first end of said clamping body, each of said third, fourth, fifth and sixth body portions comprise a projection adjacent said longitudinal axis; and said biasing means comprises a ring-shaped resilient member disposed about said projections to bias said third, fourth, fifth and sixth body portions towards said longitudinal axis.

12. The apparatus according to claim 11, wherein:

said lever means has a first end and a second end, said first end of said lever means being pivotably mounted with respect to said clamping body, and said second end of said lever means being pivotable towards and away from said clamping body;

said lever means has a first side and a second side with an orifice therein from said first side to said second side adjacent said first end;

said threaded rod passes through said orifice of said lever means;

said threaded rod comprises conical surface portions adjacent said first and second sides of said lever means;

said threaded rod has a first end adjacent said metering means and a second end opposite to said first end;

said means for rotating comprises a friction surface at said first end of said threaded rod, said friction surface comprising a knurled nut;

said threaded rod further comprises compression springs disposed between said knurled nut and said conical surfaces to compress said conical surfaces into engagement with said lever means for movement of said threaded rod upon movement of said lever means, and movement of said lever means upon rotation of said threaded rod;

said means for supplying ink further comprises a metered gauge disposed adjacent said second end of said lever means, said metered gauge being configured to represent the gap width between said first member of said metering means and said receiving roller;

said second end of said lever means being pivotable adjacent said metered gauge to indicate the position of said first member with respect to said receiving roller;

said first end of said threaded rod comprises means for connecting said first member to said threaded rod;

said connecting means comprises a flexible joint;

said third, fourth, fifth and sixth body portions each comprise an approximately ¼ section of said clamping body;

said means for supplying ink further comprises one additional toothed gear disposed within said first slot, said toothed gears being disposed on opposite sides of said longitudinal bore of said clamping body;

said fourth and sixth body portions comprise a journal pin disposed therebetween traversing said first slot, said additional toothed gear being rotatably mounted on said journal pin between said fourth and sixth body portion;

each of said toothed gears comprise a first side surface and a second side surface; and said clamping body further comprises friction means disposed between said body portions and said first and second side surfaces of said toothed gears.

13. A method for supplying ink to an ink distribution roller in a printing press, the printing press comprising means for holding a supply of ink; a receiving roller for receiving ink from said ink supply means and for distributing the ink to said ink distribution roller, said receiving roller having an inkable width with a plurality of ink zones defined along the inkable width; and a plurality of metering means corresponding to said ink zones for determining an amount of ink received by said receiving roller in each of said ink zones, each of said metering means comprising: means for finely adjusting said metering means to finely adjust said metering means and precisely determine the amount of ink received by said receiving roller, and means for overriding said fine adjustment means to coarsely adjust said metering means, said coarse adjusting being substantially coarser than said fine adjusting; said means for finely adjusting comprising: a threaded rod having threads disposed therearound, said threaded rod defining a longitudinal axis, and said threaded rod being movable in an axial direction along said longitudinal axis to adjust said metering means; at least one second member having means for engaging said threads of said threaded rod; means for resisting movement of said at least one second member for maintaining said threads of said at least one second member in a substantially fixed position; and means for rotating said threaded rod to move said threaded rod over said at least one second member in said axial direction to adjust said metering means; and said means for overriding said fine adjustment means comprises means for applying an axial force on said threaded rod to overcome said means for resisting movement to displace said means for engaging of said second member and move said threaded rod in an axial direction; said method comprising the steps of:

providing ink into said ink supply means; and adjusting predetermined ones of said metering means to determine an amount of ink received by said receiving roller in each of said plurality of ink zones, said adjusting comprising, for said ones of said plurality of ink zones, at least one of:

finely adjusting said metering means to precisely determine the amount of ink received by said receiving roller; and overriding said fine adjustment means to coarsely adjust said metering means;

said fine adjusting comprising the steps of:

resisting movement of said at least one second member to retain said means for engaging of said at least one second member in a substantially fixed position;

turning said threaded rod to longitudinally displace said threaded rod with respect to said at least one second member; and finely adjusting said metering means via said turning of said threaded rod; and said overriding of said fine adjustment means comprises:

applying an axial force on said threaded rod sufficient to overcome said means for resisting movement;

overcoming said means for resisting movement to move said at least one second member and displace said means for engaging of said at least one second member;

displacing said means for engaging of said at least one second member in said axial direction to axially displace said threaded rod; and axially displacing said threaded rod to coarsely adjust said metering means.

14. The method according to claim 13, wherein:

each said metering means comprises a first member disposed adjacent said receiving roller and movable with respect to said receiving roller to define an ink gap between said receiving roller and said first member, said ink gap corresponding to a thickness of ink deposited on said inking roller;

said first member being operatively connected to said threaded rod to move along with said threaded rod;

said means for engaging of said second member comprises threads for engaging said threads of said threaded rod;

said means for resisting movement of said at least one second member comprises means for frictionally engaging said at least one second member to retain said threads of said second member in a substantially fixed position; and said means for overriding said fine adjustment means comprises means for releasing said means for frictionally engaging to axially displace said threads of said second member in said axial direction;

said fine adjusting further comprises the steps of:

retaining said threads of said second member in a substantially fixed position;

moving said first member with respect to said receiving roller via said turning of said threaded rod; and setting said ink gap between said first member and said receiving roller to determine a thickness of ink deposited on said inking roller; and said overriding said fine adjustment means comprises:

releasing said means for frictionally engaging; and coarsely moving said threaded rod in said longitudinal direction by axially displacing said threads of said second member in said axial direction.

15. The method according to claim 14, wherein:

said second member comprises at least one toothed gear;

said means for frictionally engaging comprises clamp means for frictionally engaging said at least one toothed gear and retaining said toothed gear from rotating;

said means for applying an axial force comprises lever means for applying an axial force on said threaded rod to move said threaded rod in said axial direction, said lever means being configured to apply an axial force sufficient to overcome said frictional engagement and rotate said toothed gear to displace said threads of said second member in said axial direction;

said fine adjusting further comprises:

clamping said toothed gear to retain said toothed gear from rotating; and said coarse adjusting further comprises:

applying an axial force on said threaded rod via said lever means to overcome said frictional engagement to displace said threads and rotate said toothed gear.

16. The method according to claim 15, wherein:

said clamp means comprises a clamping body, said clamping body defining a longitudinal axis, and said clamping body has a longitudinal bore disposed along said longitudinal axis;

said threaded rod is disposed through said longitudinal bore;

said clamping body comprises a first slot intersecting with said longitudinal bore, said first slot dividing said clamping body into a first portion and a second portion;

said at least one toothed gear is disposed within said first slot between said first portion and said second portion;

said clamping body comprises biasing means configured for pulling said first portion and said second portion towards one another to frictionally engage and clamp said toothed gear therebetween; and said said fine adjusting further comprises:

frictionally engaging said toothed gear between said first and second body portions with said biasing means;

turning said threaded rod within said clamping body in engagement with said frictionally engaged toothed gear; and said coarse adjusting further comprises:

overcoming the frictional engagement produced by said biasing means to rotate said threaded gear within said first slot, thereby allowing said threaded rod to be moved axially within said longitudinal slot.

17. The method according to claim 16, wherein:

said clamping body comprises one additional slot intersecting said longitudinal bore and disposed substantially transverse to said first slot;

said additional slot dividing said first portion into third and fourth portion and dividing said second portion into fifth and sixth portions;

said biasing means pulls each of said third, fourth, fifth and sixth portions towards one another towards said longitudinal axis of said clamping body;

said third and fifth portions are disposed adjacent one another and comprise a journal pin disposed therebetween and traversing said first slot, said toothed gear being rotatably mounted on said journal pin to rotate upon the frictional engagement being overcome; and said biasing means biasing said toothed gear into engagement with said threaded rod.

18. The method according to claim 17, wherein:

said clamping body has a first end disposed towards said lever means, and an outer surface, the outer surface being disposed a distance from said longitudinal bore;

said first and said additional slot each have a slot length extending from the first end of said clamping body along said longitudinal axis of said clamping body, said first and said additional slot each have a first end at said first end of said clamping body, and a second end within said clamping body;

said clamping body further comprises a peripheral slot disposed about said longitudinal axis adjacent said second end of said first and said additional slot, said peripheral slot extending from said outer surface of said clamping body towards said longitudinal bore along a substantial portion of the distance between said outer surface and said longitudinal bore;

at said first end of said clamping body, each of said third, fourth, fifth and sixth body portions comprise a projection adjacent said longitudinal axis;

said biasing means comprises a ring-shaped resilient member disposed about said projections to bias said third, fourth, fifth and sixth body portions towards said longitudinal axis;

said lever means has a first end and a second end, said first end of said lever means being pivotably mounted with respect to said clamping body, and said second end of said lever means being pivotable towards and away from said clamping body;

said lever means has a first side and a second side with an orifice therein from said first side to said second side adjacent said first end;

said threaded rod passes through said orifice of said lever means;

said threaded rod comprises conical surface portions adjacent said first and second sides of said lever means;

said applying an axial force on said threaded rod comprises pivoting said lever means about said first end of said lever means to force said lever means to press against one of said conical surfaces to thereby transmit the applied force from said teeth of said threaded rod to said toothed gear, causing said toothed gear to rotate upon application of a force sufficient to overcome said frictional engagement of said toothed gear between said third and fifth body portions;

said threaded rod has a first end adjacent said metering means and a second end opposite to said first end;

said means for rotating comprises a friction surface at said first end of said threaded rod, said friction surface comprising a knurled nut, and said rotating comprises grasping said knurled nut and rotating said knurled nut to rotate said threaded rod;

said threaded rod further comprises compression springs disposed between said knurled nut and said conical surfaces to compress said conical surfaces into engagement with said lever means for movement of said threaded rod upon movement of said lever means, and movement of said lever means upon rotation of said threaded rod;

said means for supplying ink further comprises a metered gauge disposed adjacent said second end of said lever means, said metered gauge being configured to represent the gap width between said first member of said metering means and said receiving roller;

said second end of said lever means being pivotable adjacent said metered gauge to indicate the position of said first member with respect to said receiving roller;

said coarse adjusting comprises axially moving said threaded rod by pivoting said lever arm to dispose said second end of said lever arm in a predetermined position adjacent said metered gauge;

said means for supplying ink further comprises one additional toothed gear disposed within said first slot, each of said toothed gears being disposed on opposite sides of said longitudinal bore of said clamping body;

said fourth and sixth body portions comprise a journal pin disposed therebetween traversing said first slot, said additional toothed gear being rotatably mounted on said journal pin between said fourth and sixth body portion;

said biasing comprises biasing said additional toothed gear into engagement with said threaded rod, and biasing said fourth and sixth body portions into frictional engagement with said additional toothed gear;

each of said toothed gears comprise a first side surface and a second side surface;

said clamping body further comprises friction means disposed between said body portions and said first and second side surfaces of said toothed gears; and and said overcoming said frictional engagement comprises overcoming the frictional engagement between said toothed gears, said friction means and said body portions.

* * * * *